US006454335B1

(12) United States Patent
Wishnick

(10) Patent No.: US 6,454,335 B1
(45) Date of Patent: Sep. 24, 2002

(54) BOOT CARRIER AND LATCHING TOOL

(75) Inventor: Robert I. Wishnick, Riverside, CT (US)

(73) Assignee: Ski Tool Company, LLC, Riverside, CT (US)

( * ) Notice: Subject to any disclaimer, the term of this patent is extended or adjusted under 35 U.S.C. 154(b) by 25 days.

(21) Appl. No.: 09/667,871

(22) Filed: Sep. 22, 2000

(51) Int. Cl.[7] ..... A45F 5/10; B65D 69/00

(52) U.S. Cl. ..... 294/141; 7/170; 280/816; 294/150; 294/153; 294/162

(58) Field of Search ..... 294/2, 137, 141–143, 294/148–150, 153, 156, 158, 159, 162, 163, 165, 170; 7/164, 165, 169, 170; 15/105; 24/70 SK, 71 SK; 81/3.09, 3.27, 15.9; 223/113; 224/220, 250; 280/816

(56) References Cited

U.S. PATENT DOCUMENTS

| | | | | | |
|---|---|---|---|---|---|
| 2,939,618 | A | | 6/1960 | Mangels | |
| 3,636,594 | A | * | 1/1972 | Faivre | 294/170 X |
| 3,864,769 | A | | 2/1975 | Hamilton | 7/17 |
| 3,902,226 | A | | 9/1975 | Messenbaugh | 24/70 SK |
| 4,210,035 | A | | 7/1980 | White | 81/3 R |
| 4,250,595 | A | | 2/1981 | Byrnes | 24/71.3 |
| D258,920 | S | | 4/1981 | White | D2/378.2 |
| 4,304,019 | A | | 12/1981 | Sava | 7/170 |
| 4,537,436 | A | | 8/1985 | Pfortmiller | 294/150 |
| 4,629,103 | A | | 12/1986 | Miller | 224/250 |
| 4,696,504 | A | | 9/1987 | Roberts, Jr. | 294/148 |
| 4,730,863 | A | * | 3/1988 | Guadnola | 294/142 X |
| 4,815,642 | A | | 3/1989 | Ray | 224/258 |
| 4,867,359 | A | | 9/1989 | Donovan | 224/202 |
| 5,240,300 | A | * | 8/1993 | Ramsey | 294/153 |
| 5,454,132 | A | | 10/1995 | Neves | 15/105 |
| 5,771,759 | A | | 6/1998 | Warren | 81/3.09 |
| 5,853,213 | A | * | 12/1998 | Simpson | 294/170 X |

FOREIGN PATENT DOCUMENTS

| | | |
|---|---|---|
| CH | 654189 A5 | 2/1986 |
| DE | 2912946 A | 9/1980 |

* cited by examiner

*Primary Examiner*—Johnny D. Cherry
(74) *Attorney, Agent, or Firm*—William J. Sapone; Coleman Sudol Sapone, P.C.

(57) ABSTRACT

A tool for assisting in the latching and unlatching of boot buckles has an elongated member, an opening at a forward end for receiving an end of a tensioning lever therein, and a loop, for engaging a pair of ski boots such that a single, small compact tool can be used as both a latching tool and a boot carrier.

16 Claims, 4 Drawing Sheets

BOOT CARRIER AND LATCHING TOOL

TECHNICAL FIELD

This invention relates to a tool for use in assisting in the opening and closing of boot latches and in carrying a pair of boots.

BACKGROUND

Quick release latches are commonly used on boots such as ski boots. These latches typically include a lever which tightens the boot around the foot. Consequently, to achieve closure, a certain degree of force is required to securely close the latch. Similarly, a corresponding amount of force must be achieved to overcome the holding force to release the latch.

Such latches are typically streamlined to reside close to the boot to avoid snagging on clothing or other items when in use, to prevent inadvertent opening. There is thus limited area available for gripping the lever, and the buckling operation can be difficult to perform. This can be complicated by other factors. For example, with ski boots, clogging with snow and ice, and the cold environment can make manipulation difficult.

Boots with these type of latches are usually special purpose boots such as ski boots which are designed for attachment to skis, and these must be carried to the ski area. These boots are large, somewhat heavy and cumbersome to carry, particularly when other equipment must be transported, i.e. skis, poles, etc.

In U.S. Pat. No. 4,210,035, a device for aiding in the opening and closing of boot buckles has an elongated member having a handle and a second end with a socket for receiving a part of a buckle tensioning lever. The socket is bifurcated and arcuately shaped. U.S. Pat. No. 4,304,019 shows a tool for opening and closing boots that has a strap to assist in releasing the bindings.

U.S. Pat. No. 4,815,642 describes a boot carrier using a double loop structure and a strap for looping around an arm. U.S. Pat. No. 4,696,501 describes a boot carrier having a U-shaped portion for carrying a pair of boots.

While various devices have been proposed, utilizing separate tools for latching, carrying boots, etc. is simply not practical for most skiers.

SUMMARY OF THE INVENTION

It is an object of the present invention to provide a tool for use in opening and closing boot latches that have a lever release mechanism.

It is a further object to provide a tool that is small, lightweight and easy to carry.

It is another object to provide a tool that has multiple functions, to conserve space and that is easy to use.

It is another object to provide a boot latch release tool also useful in carrying a pair of boots.

It is yet another object to provide a tool that is inexpensive to make.

These and other objects of the present invention are achieved by a tool for use with a boot having at least one lever operated release mechanism, the tool comprising an elongated member having an opening at a forward end thereof to receive an end portion of a release lever therein, the member being substantially flat and tapering from the forward end to the rearward end thereof, flexible loop means engaged to the member and having a length sufficient to engage a release mechanism disposed on each of a pair of boots, the elongated member being a handle for carrying the boots.

Using the present invention, a single tool is useful for latching and unlatching a boot tensioning lever via the opening, with the tool used as well as a handle for carrying a pair of boots compactly, yet the tool is small enough to carry in a pocket.

DETAILED DESCRIPTION OF THE INVENTION

Figure 1:
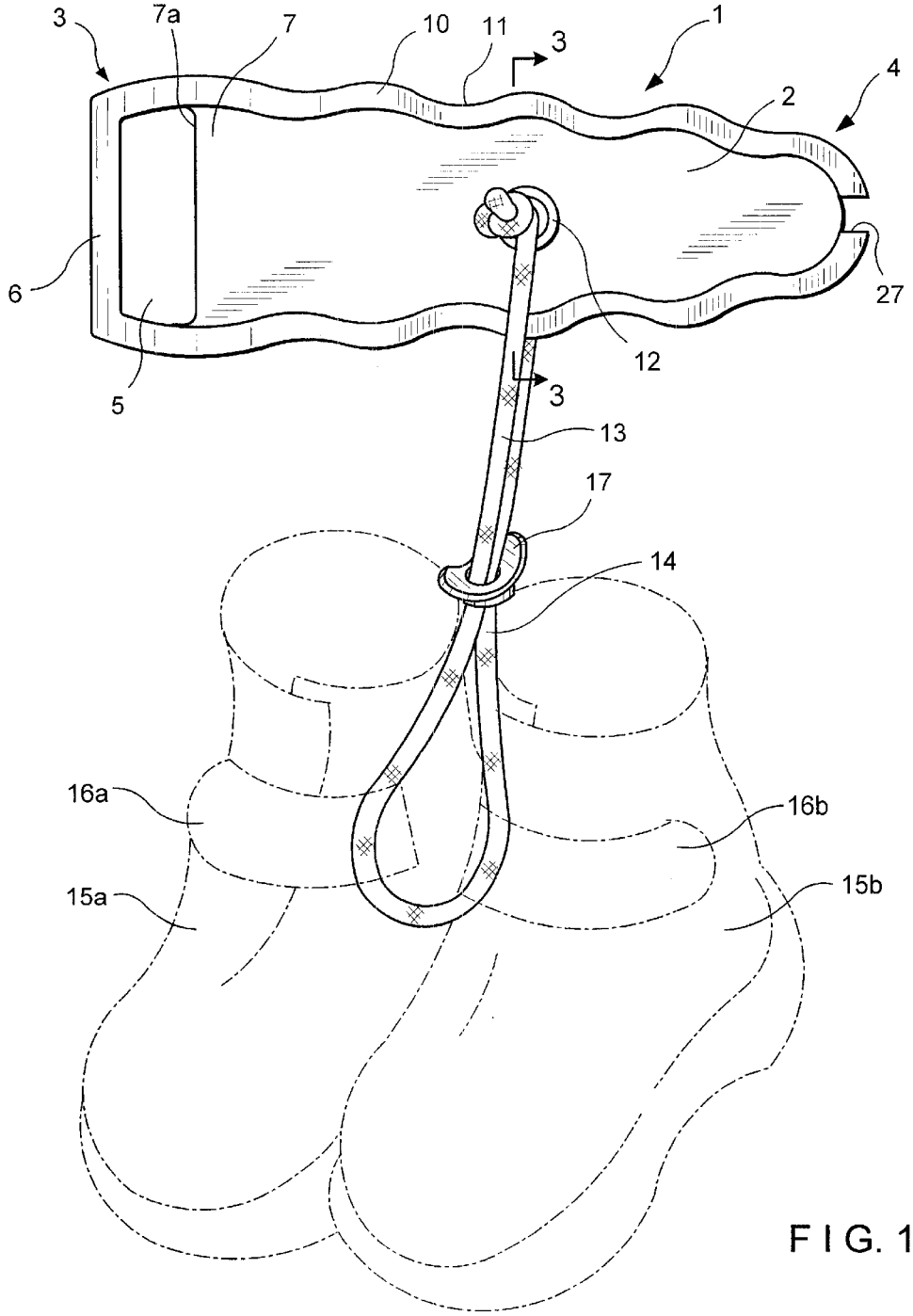
FIG. 1 is a view showing the inventive tool when used as a boot carrier.

Referring to FIG. 1, a tool 1 has an elongated member 2 that is substantially flat. The member 2 has a length approximately the width of a hand. The tool 1 has a forward end 3 and a rearward end 4. The forward end has an opening 5 in close proximity thereto, and preferably bounded at the forward end by a bridge 6. The bridge is preferably narrow and thin. The opening has a width sufficient to receive an end of a typical boot lever therein. The length of the opening is sufficient to receive the end of the lever, the opening bounded by a rearward engaging surface 7. Another engaging surface 7*a* is disposed on the opposite side of the elongated member.

Figure 2A:
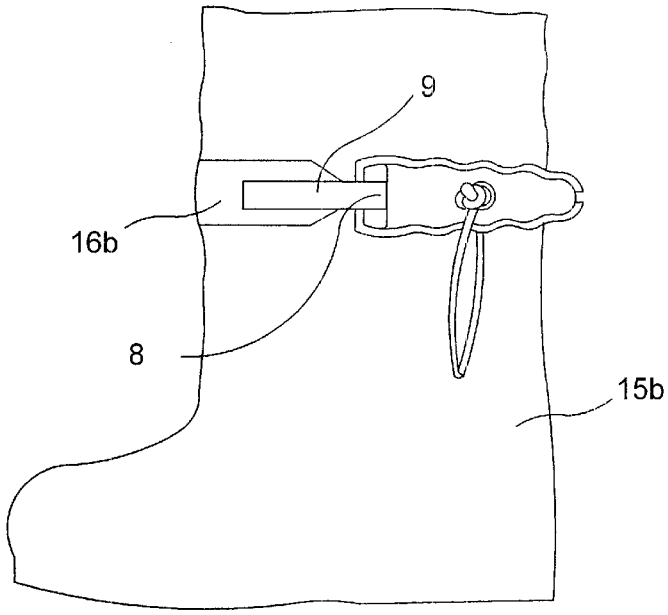
FIG. 2*a* and FIG. 2*b* are views showing the tool engaged to a tensioning lever.
Figure 2B:
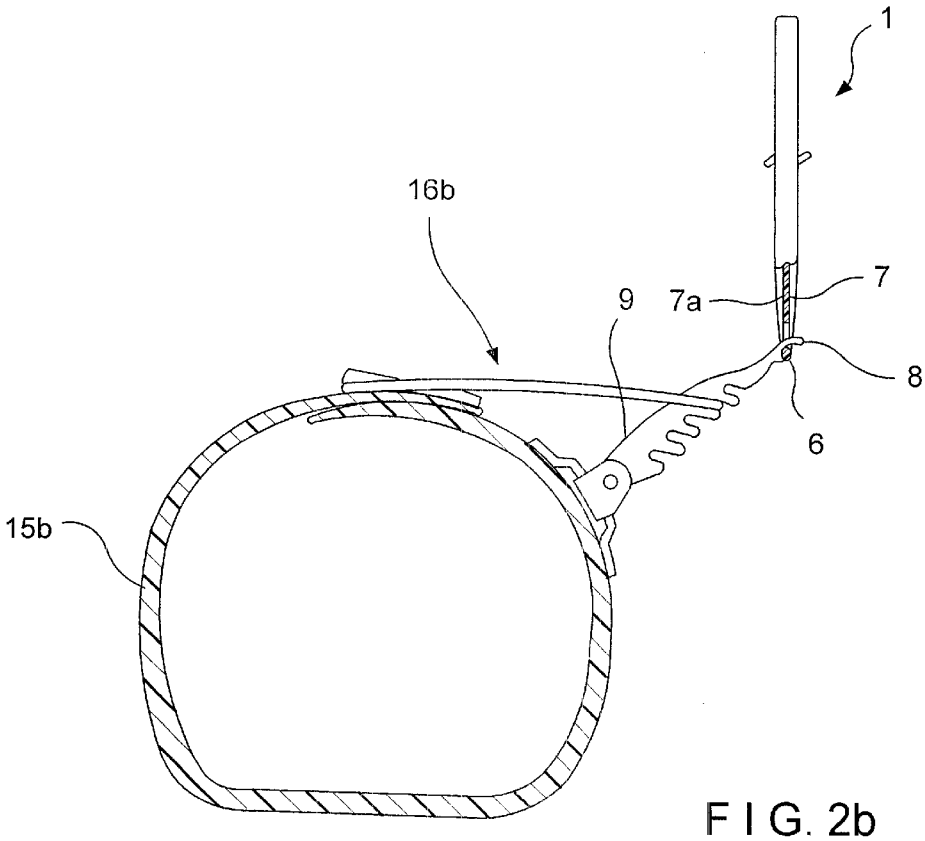

Referring to FIGS. 2*a* and 2*b*, it is seen that by angling the tool 1, an end 8 of a boot lever 9 can pass the bridge and enter the opening and be received adjacent to the engaging surface. Pivoting the tool in a closing direction locks the lever end between the engaging surface and the bridge, and allows the tool to become an extension of the lever. As the tool can be engaged by a full hand grip, this multiplies the force that can be applied, and makes it relatively easy to displace the lever. The same procedure in reverse assists in opening the lever.

Preferably, the tool has a peripheral flange 10 to improve comfort and further may incorporate an undulating surface 11 to improve the grip. The wide flange engages the hand and thus the width improves comfort, though this may be eliminated if the elongated member has an overall thickness sufficient to serve this purpose.

The elongated member tapers from the forward end to the rearward end, also to improve gripping, and to minimize the size of the tool.

The tool has a through hole 12 for receiving a flexible cord 13 therein, the cord forming a loop 14. The through hole is preferably provided at about the center thereof to balance the weight carried at about the center of the hand. The loop can perform several functions but its primary purpose is to carry a pair of boots 15*a* and 15*b*. Thus, the cord must be relatively strong to carry the anticipated weight. The cord has a length sufficient to engage at least one latch 16*a* and 16*b* on each of a pair of boots, with some clearance between the boot tops and the elongated member, which forms a handle for carrying the boots. When not used for carrying boots, the cord can fit over an arm or wrist to carry the tool, which allows the tool to be used during skiing, to perform some of the optional functions described below.

Referring again to FIG. 1, the tool is shown in use as a boot carrier. The loop 14 is placed inside a pair of the opposed latches on the ski boots. The latches are then closed and the tool pulled upward to snug the cord and move the boots against each other. An optional tightening grommet 17 may be provided, to shorten the loop and thereby keep the boots secured. The boots can then be carried quite easily, using the elongated member as a carrying handle.

Figure 3:
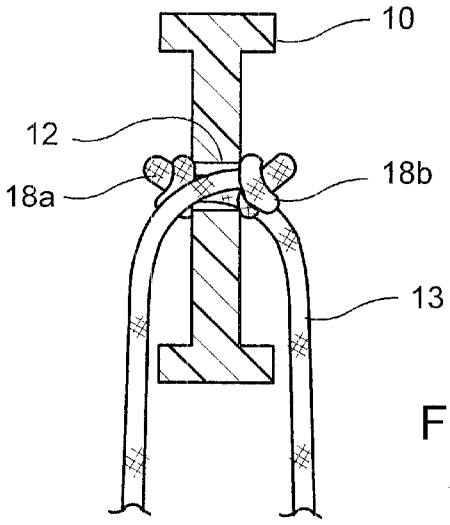
FIG. 3 is a cross-sectional view of the tool of FIG. 1.

Referring to FIG. 3, a cross section of the tool is shown. While various means for attaching the cord to the tool are possible, one method is to provide a through hole 12 of a size sufficient to pass two cords therethrough, so that two ends 18*a* and 18*b* of a single cord can pass through the hole, each end knotted to prevent withdrawal.

Figure 4A:
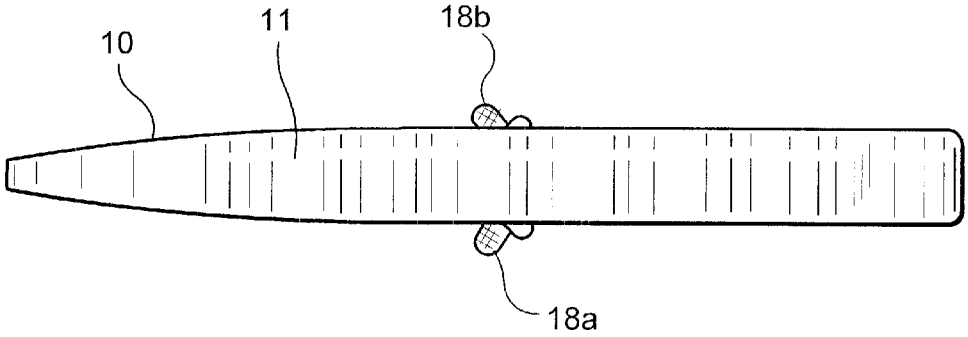
FIG. 4*a* is a top view of the tool of FIG. 1.
Figure 4B:
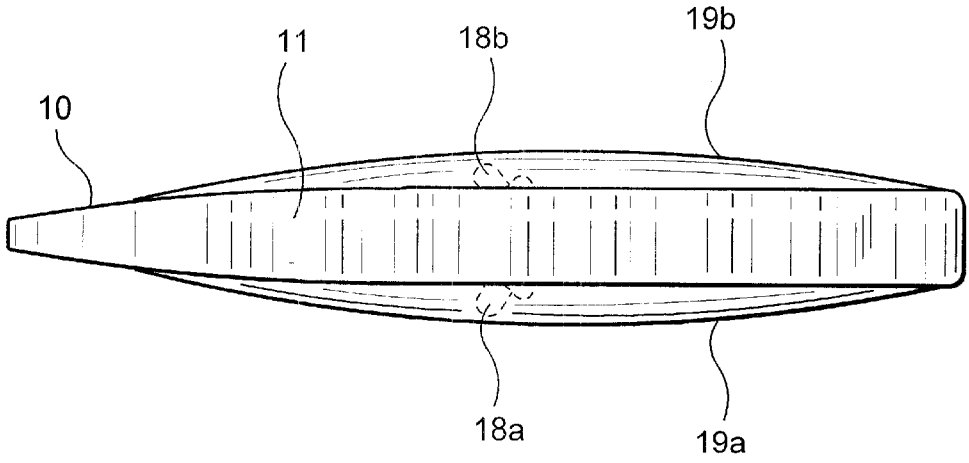
FIG. 4*b* is an alternative embodiment including gripping cushions.

FIG. 4*a* shows a top view of the tool of FIG. 1. In an alternative embodiment of the invention, shown in FIG. 4*b*, opposing sides of the of the tool can each receive a cushion 19*a*, 19*b* to improve user comfort, particularly when carrying boots.

Figure 5A:
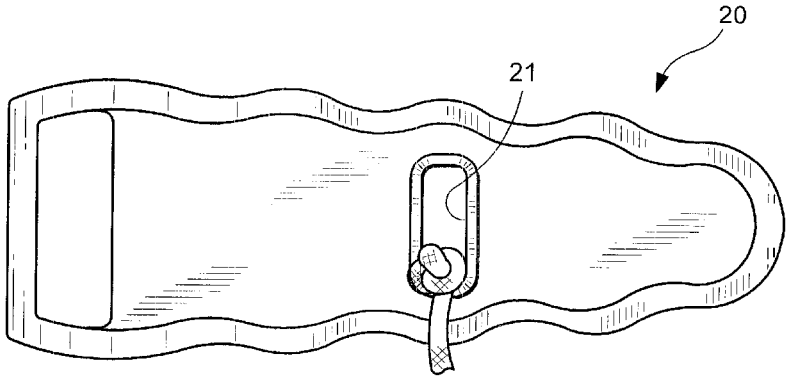
FIG. 5*a* is a view of another alternative embodiment of the tool including a slot.
Figure 5B:
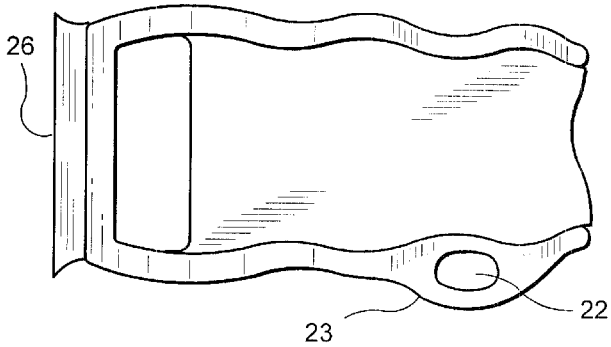
FIG. 5*b* is a view showing the tool with a projecting gusset and a wiper.

Referring to FIG. 5*a*, an alternative embodiment of the tool is shown. A tool 20 has a through hole in the form of a slot 21. The slot allows the ends of the cord to move toward the edge where the load will be carried. This reduces the twisting moment applied by the load when the through hole is centered. FIG. 5*b* shows a through hole 22 located in a projecting gusset 23 that can be formed integral with the peripheral flange. In each case, the flexible cord is engaged to the elongated member such that the member becomes a handle for carrying a pair of boots.

Figure 6:
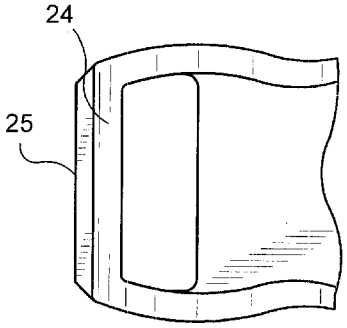
FIG. 6 is an alternative embodiment of the invention having a scraper edge.

In another embodiment of the invention, shown in FIG. 6, a bridge 24 has a forward lip 25 that is tapered to form a scraping edge. Thus, the tool can additionally be used as a scraper. In FIG. 5*b*, a resilient elastomer strip 26 is mounted, by adhesive bonding or other means, to the bridge for use as a wiper for clearing water off ski goggles.

Figure 7:
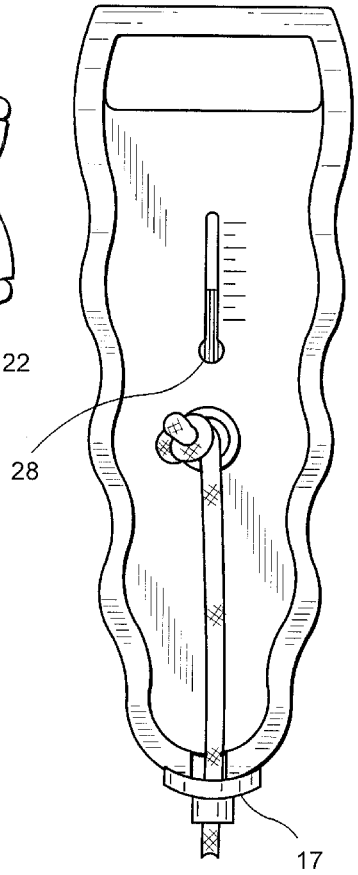
FIG. 7 is a view of the tool incorporating an optional thermometer.

Another optional feature is a recess 27 located in the rearward end of the tool, as shown in FIGS. 1 and 7, the recess approximating the diameter of the cord so that it can be snugly received therein. This locks the tool and cord together to limit rotation of the tool, for example if worn on the arm or wrist, and as shown, the grommet 17 can be moved into proximity with the recess to hold the cord in that orientation.

Referring to FIG. 7, the tool has an optional thermometer 28 mounted thereto, so that a skier can accurately assess ski conditions, for selection of proper waxes,etc. Of course, these various optional features can all be provided in a single tool or selected ones incorporated with the tool so that various combinations can be made.

The tool may be made of many materials such as wood, metal or plastic, but plastic is preferred to minimize cost and weight. Many plastics can be used, both thermoplastics and thermosets, including epoxies, nylon, polyesters, polyethylene, polystyrene, acrylonitrile butadiene styrene (ABS), polycarbonates, etc., and the invention is not limited by the choice of material used.

The cord used is of conventional construction, though it must be of sufficient length and strength to carry the anticipated weight of a pair of boots. While a cord that is knotted is shown, it should be understood that other conventional means to form the loop, such as by using a coupling, could be used in the invention.

While preferred embodiments of the invention have been shown and described, it will be understood by those skilled in the art that other changes or modifications can be made without varying from the scope of the invention.

I claim:

1. A tool for use with a boot having at least one lever operated release mechanism comprising:

an elongated member having an opening at a forward end thereof to receive an end portion of a release lever therein, the member being substantially flat and tapering from the forward end to a rearward end thereof, flexible loop means engaged to the member and having a length sufficient to engage a release mechanism disposed on each of a pair of boots, the elongated member being a handle for carrying the boots engaged by the loop means.

2. The tool of claim 1 wherein the elongated member has a peripheral hand engaging flange.

3. The tool of claim 1 wherein the elongated member has an undulating peripheral gripping surface.

4. The tool of claim 1 wherein the forward end of the tool has a forward scraping edge.

5. The tool of claim 1 wherein the elongated member has a through hole for receiving the loop means therein.

6. The tool of claim 5 wherein the loop means is a cord having knotted ends located on opposite sides of the through hole.

7. The tool of claim 5 wherein the through hole is a slot.

8. The tool of claim 5 further comprising a gusset extending from the peripheral surface of the elongated member, the through hole located therein.

9. The tool of claim 1 wherein the opening is bounded at the forward end by a bridge and at a rearward end by at least one lever engaging surface.

10. The tool of claim 1 further comprising resilient cushions located on opposite sides of the elongated member to form a cushioned hand grip.

11. The tool of claim 1 wherein the loop means is a cord.

12. The tool of claim 1 further comprising a thermometer mounted thereto.

13. The tool of claim 1 wherein the forward end of the elongated member has a resilient strip mounted thereto to form a wiper.

14. The tool of claim 1 further comprising a recess in the rearward end for securely receiving a portion of the cord therein.

15. The tool of claim 1 wherein the elongated member is composed of a material selected from the group consisting of wood, metal and plastic.

16. The tool of claim 1 further comprising a grommet slidable on the loop means for adjusting the size of the loop formed by the loop means.

* * * * *